US006695202B2

(12) United States Patent
Miess

(10) Patent No.: US 6,695,202 B2
(45) Date of Patent: Feb. 24, 2004

(54) DISPOSABLE FOOD SERVICE CONTAINER

(75) Inventor: Kenneth R. Miess, Elk Grove Village, IL (US)

(73) Assignee: Field Container Company, LP., Elk Grove Village, IL (US)

( * ) Notice: Subject to any disclaimer, the term of this patent is extended or adjusted under 35 U.S.C. 154(b) by 0 days.

(21) Appl. No.: 10/314,673

(22) Filed: Dec. 9, 2002

(65) Prior Publication Data

US 2003/0085263 A1 May 8, 2003

Related U.S. Application Data

(63) Continuation of application No. 09/716,494, filed on Nov. 20, 2000.

(60) Provisional application No. 60/205,278, filed on May 18, 2000.

(51) Int. Cl.[7] ..... B65D 5/00

(52) U.S. Cl. ..... 229/115; 229/117.01; 229/160.2; 229/243

(58) Field of Search ..... 229/115, 924, 229/160.2, 223, 243, 242, 117.01, 117.02; 206/815

(56) References Cited

U.S. PATENT DOCUMENTS

| | | | | | |
|---|---|---|---|---|---|
| 662,969 | A | * | 12/1900 | Roth | 229/115 |
| 1,814,561 | A | * | 7/1931 | Krumm | 229/115 |
| 2,100,888 | A | * | 11/1937 | Vine | 229/115 |
| 2,107,946 | A | * | 2/1938 | Inman | 229/115 |
| 3,142,430 | A | * | 7/1964 | Meyers | 229/240 |
| 4,477,014 | A | * | 10/1984 | Brandenburger | 229/115 |
| 4,492,333 | A | * | 1/1985 | Roberts | 229/115 |
| 4,798,323 | A | * | 1/1989 | Platt | 229/115 |
| 6,102,568 | A | * | 8/2000 | Davis | 229/115 X |

* cited by examiner

*Primary Examiner*—Tri M. Mai
(74) *Attorney, Agent, or Firm*—Marshall, Gerstein & Borun LLP

(57) ABSTRACT

A food container has a top and a bottom joined by sides walls. An interface between the top and the side walls is perforated to permit separation of the top from the side walls. The top and bottom being formed with fold lines, the fold lines adapted to permit the container to be collapsed to a first, substantially flat configuration and to be erected to a second erect configuration wherein the top, bottom and side walls define an interior. A tab is formed in the top, and the tab is arranged to be grasped and pulled to separate the top from the side walls for opening the container.

12 Claims, 3 Drawing Sheets

DISPOSABLE FOOD SERVICE CONTAINER

CROSS-REFERENCE TO RELATED APPLICATIONS

The present application claims priority under §119(e) to U.S. Provisional Patent Application Ser. No. 60/205,278 filed May 18, 2000, and is a continuation of U.S. patent application Ser. No. 09/716,494 filed Nov. 20, 2000, both of which are expressly incorporated herein.

FIELD OF THE INVENTION

The present invention relates generally to containers, such as food containers, and more particularly, the present invention relates to a food container that may be preassembled and stored in a flat configuration, easily formed, securely closed and easily opened into a serving configuration.

BACKGROUND OF THE INVENTION

Disposable containers have long been used in the food service industry for packaging carry-out food. These containers take on a variety of shapes and sizes, and the particular size and shape is generally dictated by the food product that the container is designed to hold. For example, triangular shaped containers are commonly used for individual slices of pizza.

The disposable containers are made from a number of different materials including polystyrene, cardboard, paper and coated paper. The material, in combination with the design of the container itself, provide both strength and resistance to leakage of the food from the container. At times, the container is also used by the customer as a tray from which to consume the food. These later types of containers often have a clam-shell configuration, wherein a lid closes over a bottom portion and is retained to the bottom portion by engagement of a tab with a slot. The lid is openable by release of the tab from the slot and raising the lid to expose the food and to provide a surface from which the food may be consumed.

There are several problems with existing food containers. The clam shell type containers do not always close securely or remain closed. Other container designs that close more securely, for example using adhesive, do not open easily. Often these containers have to be torn open resulting in spillage of the food from within the container. Also, these containers may not open to a suitable tray from which the food may be consumed.

Another problem with food containers relates to storage and access of the container within the food preparation facility. Clam shell containers are often stacked together in an inter-engaging fashion with the containers in the open configuration. It is thus necessary to separate one container from a tightly packed stack of containers during the food preparation process. This makes obtaining a single container from the stack very difficult particularly if the containers are stored on shelving located above a food preparation area.

Other kinds of containers, typically paper food containers, may be stored as flat sheets. However, these containers require assembly within the food preparation facility, which may require additional work space be dedicated for the assembly of containers and labor resource be dedicated to assembling containers. Containers may be preassembled apart from the food preparation facility; however, the preassembled containers occupy the entire volume of the container and results in fewer containers being stored at the food preparation facility and inefficient use of space within the food preparation facility.

Thus, there is a need for a food container that may be preassembled yet stored flat, easily assembled, securely retain the food product and easily opened.

DETAILED DESCRIPTION OF THE PREFERRED EMBODIMENTS

Figure 1:
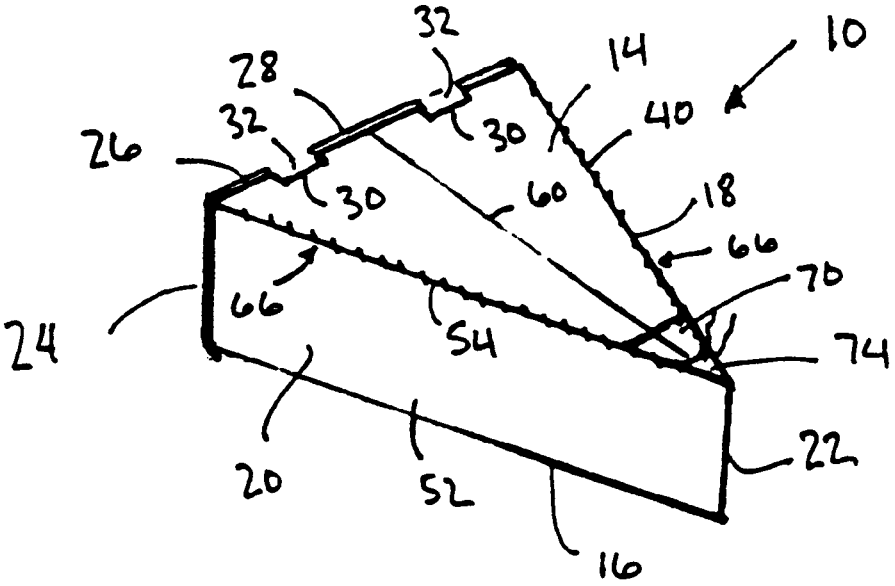
FIG. 1 is perspective view of a container in accordance with a preferred embodiment of the invention in a closed configuration.

Referring to FIG. 1, a disposable food container 10 in accordance with a preferred embodiment of the invention has a wedge shape sized to receive a single slice of pizza. Of course it will be appreciated that a container in accordance with the preferred embodiments of the invention may take on virtually any shape as dictated by the food, or other product, to be disposed within the container. The container 10 has a top 14, a bottom 16, a first side wall 18 and a second side wall 20 joining the top 14 and the bottom 16. The top 14, bottom 16, first side wall 18 and second side wall 20 coverage to an enclosed end 22 of the food container 10 and further define an open end 24 of the food container 10.

A first end flap 26 and a second end flap 28 are formed integral to the top 14 and the bottom 16, respectively, at the open end 24 of the container 10. The first end flap 26 includes slots 30, and the second end flap 28 includes tabs 32 arranged to be received within the slots 30 to retain the end flaps 26 and 28 over the open end 24 to enclose the food container 10, as shown in FIG. 1.

Figure 2:
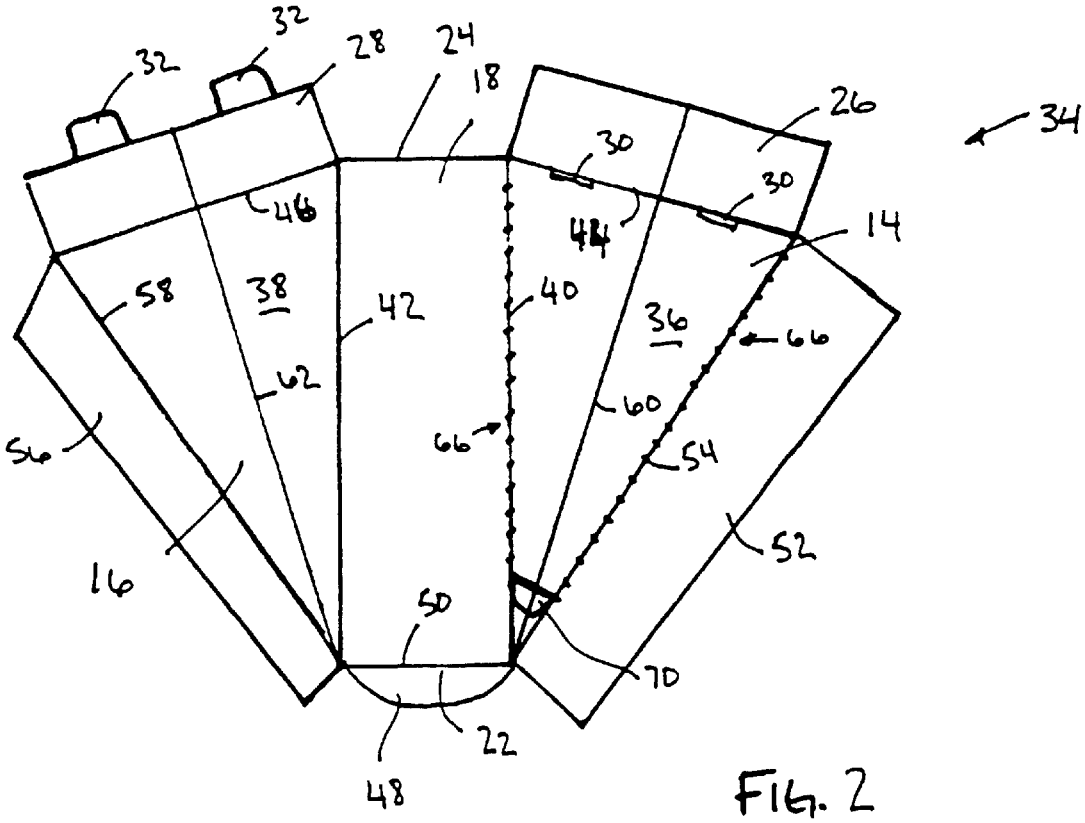
FIG. 2 is a plan view of a blank for forming the container illustrated in FIG. 1.

Referring to FIG. 2, the food container 10 is formed from a blank 34 that has two generally triangular shaped segments 36 and 38 that are joined to first side wall 18 along a fold line 40 and a fold line 42, respectively. The segment 36 corresponds to the top 14 while the segment 38 corresponds to the bottom. The first end flap 26 extends from the top 14 as defined by a fold line 44. The second end flap 28 extends from the bottom 16 as defined by a fold line 46. The first side wall 18 is also formed to include a tab 48 extending from the first side wall as defined by a fold line 50. The top 14 is also formed to include a first flap 52 extending from the top 14 as defined by a fold line 54. The bottom is also formed to include a second flap 56 extending from the bottom 16 as defined by a fold line 58. The top 14 and the bottom 16 are further formed to include longitudinally extending fold lines 60 and 62, respectively.

Figure 3:
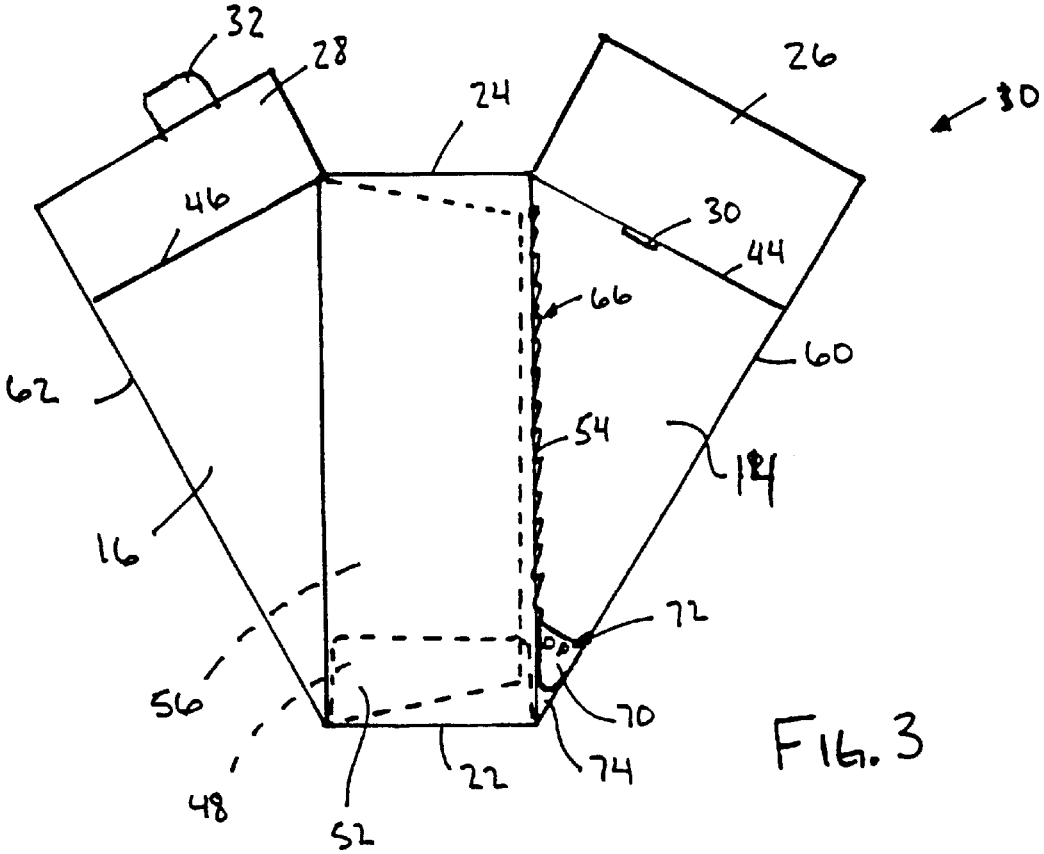
FIG. 3 is a plan view of the container illustrated in FIG. 1 in a first preassembled configuration.

Referring to FIG. 3, from the flat blank configuration illustrated in FIG. 2, the top 14 is folded along fold line 60 and the bottom is folded along fold line 62 to bring the first flap 52 into engagement with the second flap 56. The first flap 52 is then secured to the second flap 56, for example, by adhesive and together the first flap 52 and the second flap 56 form the second side wall 20 of the container 10. In addition, tab 48 is folded along fold line 50 and is secured to the second side wall 20, and preferably within the interior of the container 10 to lock-in the enclosed end 22. In accordance with the preferred embodiments of the invention, as illustrated in FIG. 3, the container 10 has a first preassembled configuration wherein the container 10 is substantially flat, and wherein the side walls 18 and 20 structurally join the top 14 and the bottom 16, the top 14 and the bottom 16 being folded along fold lines 60 and 62, respectively. Thus, the container 10 may be manufactured in quantity in the first preassembled configuration, which is easily and efficiently stored flat near or around the food preparation area. As will be described in more detail below, the container 10 is also easily converted to a second preassembled configuration, wherein the interior and open end 24 are defined for receiving a serving of food, or other product, to be received within the container 10.

Figure 4:
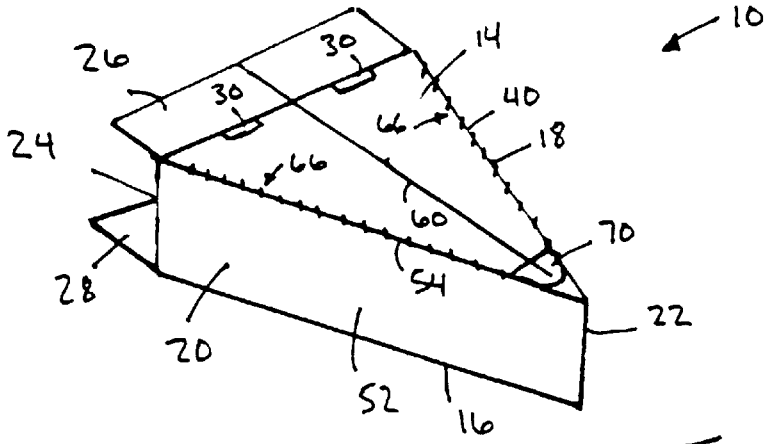
FIG. 4 is a perspective view of the container illustrated in FIG. 1 in a second preassembled configuration.

Referring to FIG. 4, from the first preassembled, flat configuration pressing inwardly on the top 14 and the bottom 16 along the fold lines 60 and 62, forms the container 10 into a second preassemble configuration that is illustrated in FIG. 4. In the second preassembled configuration the container 10 includes an interior for receiving a serving of food. The interior is accessible through the open end 24 adjacent the end flaps 26 and 28. The container 10 is closed by folding the end flaps 26 and 28 over the open end 24, and engaging the tabs 30 in the slots 32 (as shown in FIG. 1). Thus, the serving of food is securely retained with the container 10.

Figure 5:
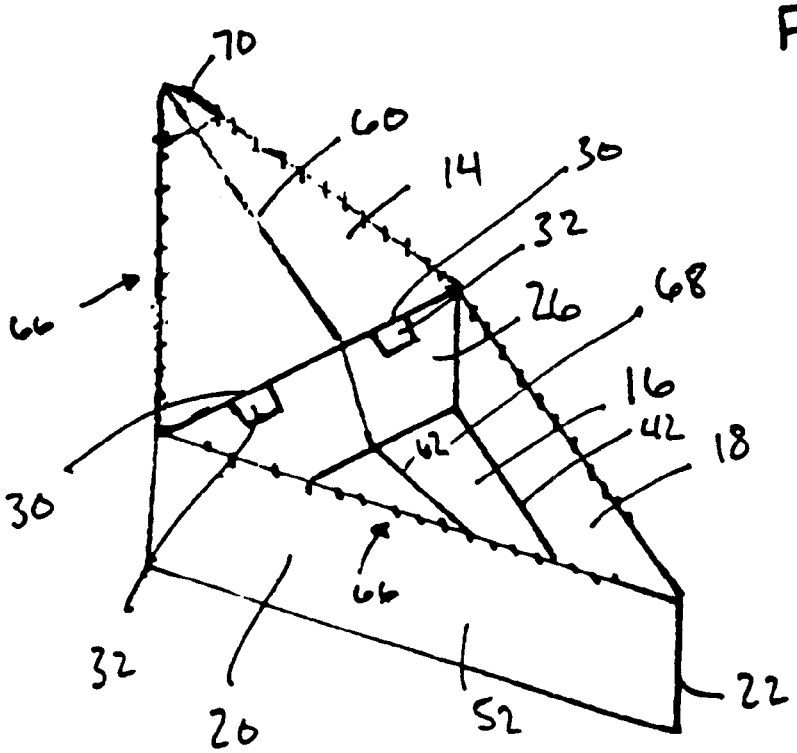
FIG. 5 is a perspective view of the container shown in FIG. 1 in an open configuration.

For opening the container 10, the fold lines 40 and 54 joining the top 14 to first side wall 18 and the second side wall 20, are formed with perforations 66 extending substantially along the entire length thereof from the open end 24 to the enclosed end 22. The perforations 66 permit the top 14 to be easily separated from the side walls 18 and 20, to open the container 10 to a serving configuration illustrated in FIG. 5. Separating the top 14 from the side walls 18 and 20 exposes the interior 68 of the container 10, and the serving of food retained therein (not depicted). The bottom 18 and the side walls 18 and 20 remain securely joined along fold lines 42 and 56, respectively, and together define a tray from which the portion of food may be consumed.

Figure 6:
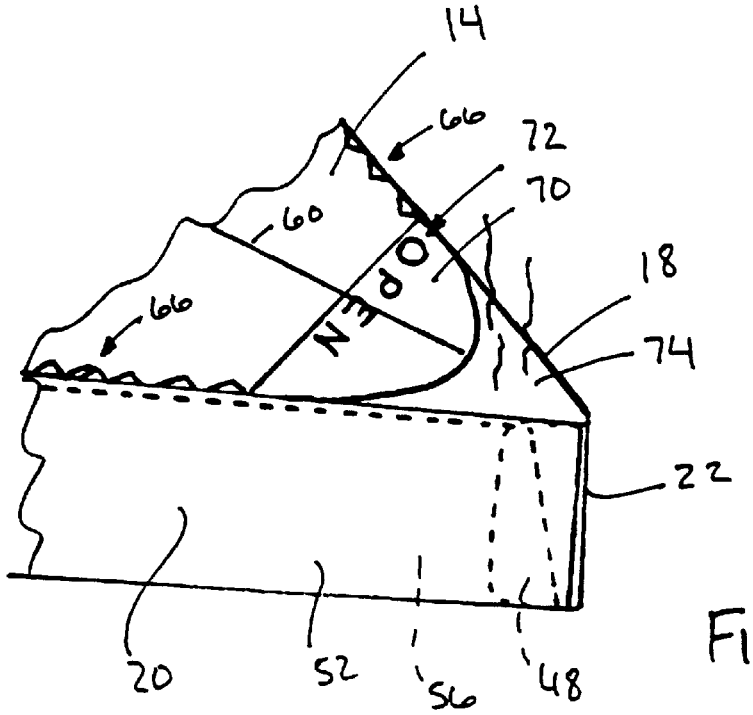
FIG. 6 is a partial perspective view of a portion of the container shown in FIG. 1.

To further assist the opening of the container 10 from its closed configuration (FIG. 1), the top 14 may be formed with a tab 70 adjacent the enclosed end 22, best seen in FIG. 6. The tab 70 is separated from the side walls 18 and 20, or alternatively, may be joined by perforations, such as perforations 66. The tab 70 may further include opening instructions 72, such as the word "OPEN," to inform the user how to open the container 10. In use, the user grasps the tab 70 and pulls back on the tab 70 separating the top 14 from the first and second side walls 18 and 20, along the fold lines 40 and 52, which separation is facilitated by the perforations 66.

Because it is intended that the container 10 be used with hot foods, the tab 70 may not extend all the way to the side walls 18 and 20, respectively. Instead, the tab may define an opening 74 between the tab 70 and the side walls 18 and 20 to permit venting of steam from the container.

Many modifications and changes may be made to the preferred embodiments described herein without departing from the inventions fair scope. The many aspects and features of the invention, and its broad scope, will be appreciated from the following claims.

What is claimed is:

1. A food container comprising:

a first flat configuration including:

a first panel having first and second edges and a first flap foldably attached to a transverse edge;

a first triangular portion foldably attached to the first edge along a first perforated foldline, the first triangular portion mirrored about a first bisecting foldline and integrally formed to include a foldable inner flap bisected along the first bisecting foldline;

a second panel having a first edge foldably attached to the first triangular portion along a second perforated foldline;

a second triangular portion foldably attached to the second edge along a third foldline, the second triangular portion mirrored about a second bisecting foldline and integrally formed to include a foldable outer flap bisected along the second bisecting foldline;

a second flap having a first edge foldably attached to the second triangular portion along a fourth foldline, the first and second flap are joinable to the second panel and cooperate to form a cone-shaped enclosure;

a second erect configuration formed by the deformation of the first triangular portion along the first bisecting foldline and the second triangular portion along the second bisecting foldline to thereby form a first triangular top separateable along the first and second perforated foldlines, and a second triangular base separated by the cooperation of the first panel, second panel, and the first and second flaps.

2. The food container of claim 1, wherein the first and second foldlines are perforated foldlines.

3. The food container of claim 1, wherein the first triangular top is completely separatable from the first and second panels such that in the second erect configuration the first panel, the second panel and the second triangular base cooperate to form a tray.

4. The food container of claim 1, wherein the first triangular top includes a pull-tab bisected by the first bisected foldline.

5. The food container of claim 3, wherein the pull-tab further includes opening instructions disposed on the pull-tab.

6. A food container comprising:

a triangular shaped container having a top, a bottom and at least three side panels in a first erect configuration, the triangular shaped container having a second flat configuration including:

a first rectangular panel forming the first side panel and having a first perforated longitudinal foldline and a second longitudinal foldlines;

a second rectangular panel forming the second side panel and having a third perforated longitudinal foldline and a fourth longitudinal foldlines;

a first isosceles triangular panel forming the top and foldably attached to the first rectangular panel along the first perforated longitudinal foldline and the second rectangular panel along the third perforated longitudinal foldline, the first triangular panel bisected by a bisecting foldline and folded along the foldline to form a pair of right triangles;

a second isosceles triangular panel forming the bottom and foldably attached to the first rectangular panel along the second longitudinal foldline and the second rectangular panel along the fourth longitudinal foldline, the second triangular panel bisected by a bisecting foldline and folded along the foldline to form a pair of right triangles; and whereby the second flat configuration defines an enclosure and wherein the first isosceles triangular panel is removable along the first and third perforated longitudinal foldlines to form a tray.

7. The food container of claim 6, wherein the first rectangular panel includes a sealing flap foldable along a transverse edge, the sealing flap engageable with the second rectangular panel along a contact strip.

8. The food container of claim 6, wherein the first isosceles triangular panel includes an outer flap foldably attached to the triangle base and bisected by the bisecting foldline and the second isosceles triangular panel includes an inner flap foldably attached to the triangle base and bisected by the bisecting foldline.

9. The food container of claim 8, wherein the foldline between the outer flap and the first isosceles triangular panel includes at least one locking slot and the inner flap includes at least one locking tab sized to engage the at least one locking slot.

10. The food container of claim 6, wherein the first and third foldlines are perforated foldlines.

11. The food container of claim 6, wherein the first isosceles triangular panel is completely separatable from the first rectangular panel and the second rectangular panel;

whereby the triangular shaped container forms a tray when the first isosceles triangular panel is separated from the first and second rectangular panels.

12. The food container of claim 6, wherein the first isosceles triangular panel includes a pull-tab bisected by the bisecting foldline.

* * * * *